US012796741B2

(12) United States Patent
Yilmaz et al.

(10) Patent No.: US 12,796,741 B2
(45) Date of Patent: Nov. 17, 2026

(54) ELECTRONIC AEROSOL PROVISION SYSTEM

(71) Applicant: Nicoventures Trading Limited, London (GB)

(72) Inventors: Ugurhan Yilmaz, London (GB); Shixiang Chen, London (GB); Mark Potter, London (GB); Simon Poynton, London (GB); Geoff Foss-Smith, London (GB)

(73) Assignee: Nicoventures Trading Limited, London (GB)

( * ) Notice: Subject to any disclaimer, the term of this patent is extended or adjusted under 35 U.S.C. 154(b) by 648 days.

(21) Appl. No.: 17/593,139

(22) PCT Filed: Mar. 10, 2020

(86) PCT No.: PCT/GB2020/050565

§ 371 (c)(1),
(2) Date: Sep. 10, 2021

(87) PCT Pub. No.: WO2020/183146

PCT Pub. Date: Sep. 17, 2020

(65) Prior Publication Data

US 2022/0183385 A1 Jun. 16, 2022

(30) Foreign Application Priority Data

Mar. 11, 2019 (GB) ..... 1903231

(51) Int. Cl.
*A24F 40/53* (2020.01)
*A24F 40/42* (2020.01)
*A24F 40/60* (2020.01)

(52) U.S. Cl.
CPC ..... *A24F 40/53* (2020.01); *A24F 40/42* (2020.01); *A24F 40/60* (2020.01)

(58) Field of Classification Search
CPC ..... A24F 40/42; A24F 40/53
See application file for complete search history.

(56) References Cited

U.S. PATENT DOCUMENTS

2014/0060554 A1* 3/2014 Collett et al. ..... A24F 47/00 131/328
2015/0258289 A1* 9/2015 Henry, Jr. et al. .... A61M 15/06
(Continued)

FOREIGN PATENT DOCUMENTS

JP WO 2018138749 A1 * 8/2018 ..... A24F 47/00
WO 2017055800 A1 4/2017
(Continued)

OTHER PUBLICATIONS

Substantive Examination Adverse Report and Search Report from corresponding Malaysian Application No. PI 2021005158, mailed Jul. 3, 2025, all pages cited in its entirety.

*Primary Examiner* — Christopher M Rodd
*Assistant Examiner* — Ronnie Kirby Jordan
(74) *Attorney, Agent, or Firm* — Burr & Forman

(57) ABSTRACT

Described is an aerosol provision system for generating aerosol from an aerosol precursor material, the system comprising a consumable part for generating aerosol that is to be provided to a user of the aerosol provision system; a reusable part configured to enable generation of aerosol from an aerosol precursor; control circuitry configured to monitor usage of the aerosol provision system; and an alert unit configured to output an alert signal, wherein the control circuitry is configured to determine when a predetermined usage condition has been met, and in response to determining that the predetermined usage condition has been met, to cause the alert unit to output an alert signal, wherein the alert unit is configured to cease output of the alert signal in response to a user input. Also described is a method of
(Continued)

generating an alert signal for use with an aerosol provision system.

18 Claims, 4 Drawing Sheets

(56) References Cited

U.S. PATENT DOCUMENTS

| | | | | |
|---|---|---|---|---|
| 2018/0043114 | A1* | 2/2018 | Bowen et al. | A24F 40/65 |
| 2018/0077967 | A1 | 3/2018 | Hatton et al. | |
| 2019/0247597 | A1* | 8/2019 | Yamada et al. | A61M 15/0065 |
| 2020/0037667 | A1* | 2/2020 | Woodcock | A24F 47/008 |

FOREIGN PATENT DOCUMENTS

| | | | | |
|---|---|---|---|---|
| WO | 2018138749 | A1 | 8/2018 | |
| WO | WO2018146453 | A1 * | 8/2018 | A24F 47/00 |
| WO | 2019073239 | A1 | 4/2019 | |

* cited by examiner

ELECTRONIC AEROSOL PROVISION SYSTEM

PRIORITY CLAIM

The present application is a National Phase entry of PCT Application No. PCT/GB2020/050565, filed Mar. 10, 2020, which claims priority from Great Britain Application No. 1903231.7, filed Mar. 11, 2019, each of which is hereby fully incorporated by reference herein.

TECHNICAL FIELD

The present disclosure relates to electronic aerosol provision systems such as nicotine delivery systems (e.g. electronic cigarettes and the like).

BACKGROUND

Electronic aerosol provision systems such as electronic cigarettes (e-cigarettes) generally contain an aerosol precursor material, such as a reservoir of a source liquid containing a formulation, typically including nicotine, or a solid material such as a tobacco-based product, from which an aerosol is generated, e.g. through heat vaporization. An aerosol source for an aerosol provision system may thus comprise a vaporizer, e.g., a heating element, arranged to vaporize a portion of the aerosol precursor material. As a user inhales on the device and electrical power is supplied to the vaporizer, air is drawn into the device through inlet holes and into the vapor generation chamber where the air mixes with the vaporized precursor material and forms a condensation aerosol. Such devices are usually provided with one or more air inlet holes located away from a mouthpiece end of the system. When a user sucks on a mouthpiece connected to the mouthpiece end of the system, air is drawn in through the inlet holes and past the aerosol source. There is a flow path connecting between the aerosol source and an opening in the mouthpiece so that air drawn past the aerosol source continues along the flow path to the mouthpiece opening, carrying some of the aerosol from the aerosol source with it. The aerosol-carrying air exits the aerosol provision system through the mouthpiece opening for inhalation by the user.

Some aerosol provision systems may also include a flavor element in the flow path through the system to impart additional flavors or otherwise modify the aerosol. Such systems may sometimes be referred to as hybrid systems and the flavor element may, for example, include a portion of tobacco arranged in the air path between the vapor generation chamber and the mouthpiece so that vapor/condensation aerosol drawn through the devices passes through the portion of tobacco before exiting the mouthpiece for user inhalation. In such hybrid devices, typically two components are being consumed during use, e.g., the aerosol precursor material and the flavor element. These components may typically be consumed at different rates, which may increase the complexity for a user of maintaining the aerosol provision system in a state which delivers an expected aerosol to the user.

Various approaches are described which seek to help address some of these issues.

SUMMARY

According to a first aspect of certain embodiments there is provided an aerosol provision system for generating aerosol from an aerosol precursor material, the system comprising a consumable part for generating aerosol that is to be provided to a user of the aerosol provision system; a reusable part configured to enable generation of aerosol from an aerosol precursor; control circuitry configured to monitor usage of the aerosol provision system; and an alert unit configured to output an alert signal, wherein the control circuitry is configured to determine when a predetermined usage condition has been met, and in response to determining that the predetermined usage condition has been met, to cause the alert unit to output an alert signal, wherein the alert unit is configured to cease output of the alert signal in response to a user input.

According to a second aspect of certain embodiments there is provided a method of generating an alert signal for use with an aerosol provision system configured to generate aerosol from an aerosol precursor material, wherein the method comprises: monitoring the usage of the system for generating aerosol; determining when a predetermined usage condition has been met based on the monitored usage of the system; and outputting an alert signal in response to determining that the predetermined usage condition has been met, until detection of a user input.

According to a third aspect of certain embodiments there is provided an aerosol provision device for enabling the generation of an aerosol from an aerosol precursor material, wherein the device is configured to be couplable to a consumable part for generating aerosol that is to be provided to a user of the aerosol provision device, the device comprising: a usage monitoring mechanism for monitoring usage of the aerosol provision device; and an alert unit configured to output an alert signal, wherein, when it is determined that a predetermined usage condition has been met on the basis of the output from the usage monitoring mechanism, the alert unit is configured to output an alert signal, wherein the alert unit is configured to cease generation of the alert signal in response to a user input.

According to a fourth aspect of certain embodiments there is provided an aerosol provision system configured to generate aerosol from an aerosol precursor material, the system comprising: a consumable part for generating aerosol that is to be provided to a user of the aerosol provision system; a reusable part configured to enable generation of the aerosol; controller means configured to monitor usage of the aerosol provision system; and alert outputting means configured to output an alert signal, wherein the controller means is configured to determine when a predetermined usage condition has been met, and in response, to determining that the predetermined usage condition has been met, to cause the alert outputting means to output an alert signal, wherein the alert outputting means is configured to cease output of the alert signal in response to a user input.

According to a fifth aspect of certain embodiments there is provided an aerosol provision system for generating aerosol from an aerosol precursor material, the system comprising: a consumable part for generating aerosol that is to be provided to a user of the aerosol provision system; a reusable part configured to enable generation of aerosol from an aerosol precursor; control circuitry configured to monitor usage of the aerosol provision system; and an alert unit configured to alert the user when a predetermined usage condition has been met on the basis of the monitored usage, wherein the control unit is configured to permit aerosol to be generated from the aerosol precursor material when the alert unit provides an alert to the user.

According to a sixth aspect of certain embodiments there is provided a method of generating an alert signal for use with an aerosol provision system configured to generate aerosol from an aerosol precursor material, wherein the method comprises: monitoring the usage of the system for generating aerosol; determining when a predetermined usage condition has been met based on the monitored usage of the system; and outputting an alert signal in response to determining that the predetermined usage condition has been met, wherein the aerosol provision system is capable of generating aerosol even when the alert signal is being output.

It will be appreciated that features and aspects of the invention described above in relation to the first and other aspects of the invention are equally applicable to, and may be combined with, embodiments of the invention according to other aspects of the invention as appropriate, and not just in the specific combinations described above.

BRIEF DESCRIPTION OF THE DRAWINGS

Embodiments of the invention will now be described, by way of example only, with reference to the accompanying drawings, in which.

DETAILED DESCRIPTION OF THE DRAWINGS

Figure 1:
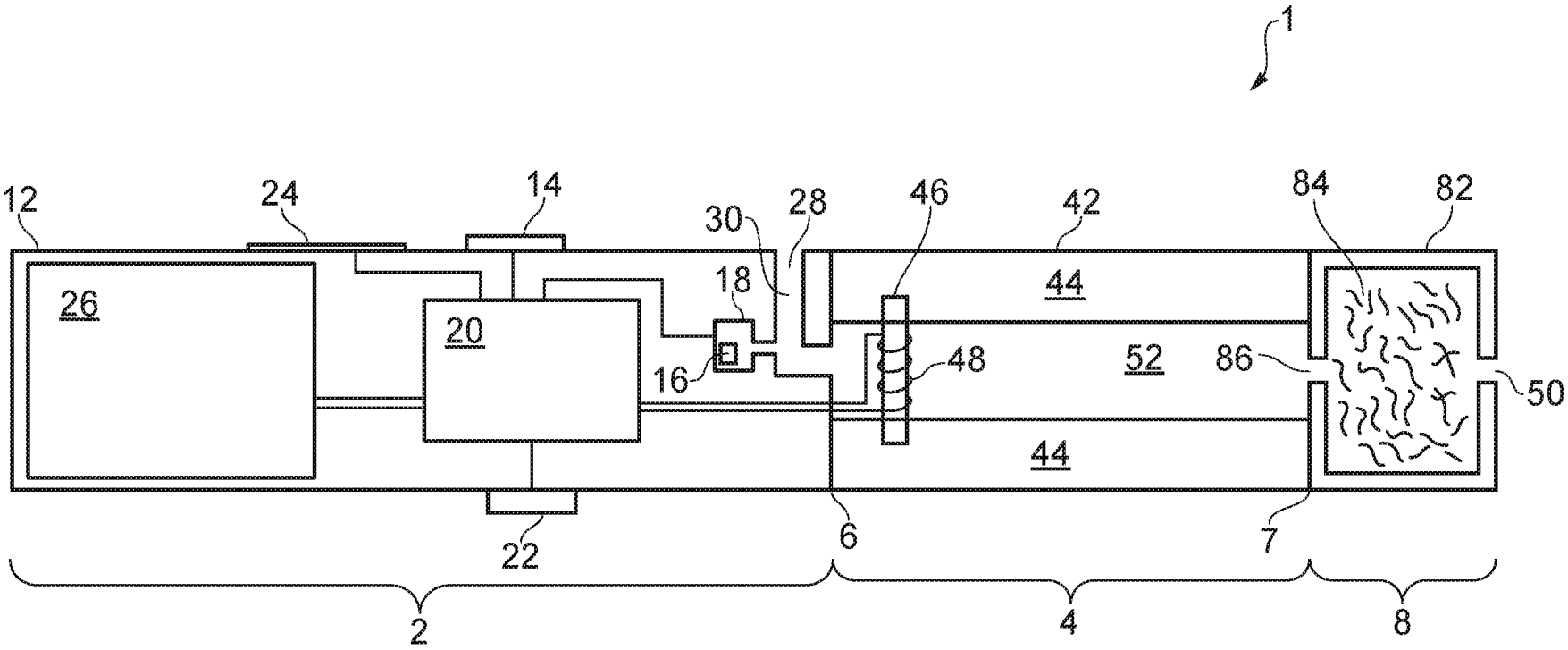
FIG. 1 schematically shows an aerosol provision system including a reusable part and a replaceable consumable part including a cartridge comprising a liquid aerosol precursor and a tobacco pod in accordance with aspects of the present disclosure.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As described above, the present disclosure relates to aerosol provision systems, such as e-cigarettes, including hybrid devices. Throughout the following description the term "e-cigarette" or "electronic cigarette" may sometimes be used, but it will be appreciated this term may be used interchangeably with vapor provision system/device and electronic vapor provision system/device. Furthermore, and as is common in the technical field, the terms "vapor" and "aerosol", and related terms such as "vaporize", "volatilize" and "aersololize", may generally be used interchangeably.

Aerosol provision systems often, though not always, comprise a modular assembly including both a reusable part and a replaceable (disposable) consumable part. Often the replaceable part will comprise the aerosol precursor material and the vaporizer, while the reusable part will comprise the power supply (e.g. rechargeable battery), an activation mechanism (e.g. button or puff sensor), and control circuitry. However, it will be appreciated these different parts may also comprise further elements depending on functionality. For example, for a hybrid device the cartridge part may also comprise the additional aerosol modifying element, e.g. a portion of tobacco, provided as a "pod". In such cases the element insert may itself be removable from the disposable cartridge part so it can be replaced separately from the cartridge, for example to change flavor or because the usable lifetime of the element insert is less than the usable lifetime of the vapor generating components of the cartridge. The reusable device part will often also comprise additional components, such as a user interface for receiving user input and displaying operating status characteristics.

For modular devices a consumable part and control unit are mechanically (and sometimes also electrically) coupled together for use, for example using a screw thread, latching or bayonet fixing with appropriately engaging electrical contacts. When the vapor precursor material in a cartridge is exhausted, or the user wishes to switch to a different cartridge having a different vapor precursor material, a cartridge may be removed from the control unit and a replacement cartridge attached in its place. Devices conforming to this type of two-part modular configuration may generally be referred to as two-part devices or multi-part devices.

It is relatively common for electronic cigarettes, including multi-part devices, to have a generally elongate shape and, for the sake of providing a concrete example, certain embodiments of the disclosure described herein will be taken to comprise a generally elongate multi-part device employing disposable cartridges with a tobacco pod insert. However, it will be appreciated the underlying principles described herein may equally be adopted for different electronic cigarette configurations, for example single-part devices or modular devices comprising more than two parts, refillable devices and single-use disposable devices, and non-hybrid devices which do not have an additional flavor element, as well as devices conforming to other overall shapes, for example based on so-called box-mod high performance devices that typically have a more box-like shape. More generally, it will be appreciated certain embodiments of the disclosure are based on electronic cigarettes that are configured to provide activation functionality in accordance with the principles described herein, and the specific constructional aspects of electronic cigarette configured to provide the described activation functionality are not of primary significance.

FIG. 1 is a cross-sectional view through an example aerosol provision system 1 in accordance with certain aspects of the disclosure. The aerosol provision system 1 comprises two main components, namely a reusable part 2 (sometimes referred to as a device part or aerosol provision device) and a replaceable/disposable consumable part.

The reusable part 2 comprises components that are intended to have a longer lifetime than the consumable part. In other words, the reusable part 2 is intended to be used, sequentially, with multiple consumable parts. The consumable part comprises components or portions that are consumed when forming an aerosol for delivery to the user during use of the aerosol provision system 1.

In the example of FIG. 1, the replaceable/disposable consumable part is formed of a cartridge 4 and a removable pod 8. As described in more detail below, the cartridge 4 comprises an aerosol precursor material, and more specifically a liquid aerosol precursor such as an e-liquid (sometimes referred to as source liquid), which is vaporized to form an aerosol, while the removable pod 8 contains a portion of tobacco or a tobacco-based product (hereinafter referred to as tobacco material 84) which is arranged to modify the aerosol generated from the e-liquid of the cartridge 4 (specifically, in the example arrangement of FIG. 1, the aerosol generated from the e-liquid is drawn through the removable pod 8 and flavor and/or nicotine is imparted to the aerosol). In other words, the aerosol that is delivered to the user is generated via the consumable part firstly by vaporizing source liquid to generate an aerosol, and secondly by passing the generated aerosol through the tobacco pod 8 to modify the aerosol, wherein it is the modified aerosol that is delivered to the user. For the sake of a concrete example, the removable pod 8 is described as containing tobacco material 84, but it should be appreciated that the removable pod 8 may contain other materials which modify the properties or composition of the aerosol (herein sometimes referred to as aerosol modifying material), for example, other plant-based materials or liquid-soaked matrices. For the sake of a concrete example, however, the removable pod 8 described herein contains tobacco material 84, and may sometimes be referred to a tobacco pod 8.

In normal use, the reusable part 2 and the cartridge 4 are releasably coupled together at a first interface 6. When the e-liquid in the cartridge 4 is exhausted or the user simply wishes to switch to a different cartridge 4, the cartridge 4 may be removed from the reusable part 2 and a replacement cartridge 4 attached to the reusable part 2 in its place. The interface 6 provides a structural, electrical and air path connection between the reusable part 2 and cartridge 4 and may be established in accordance with conventional techniques, for example based around a screw thread, latch mechanism, or bayonet fixing with appropriately arranged electrical contacts and openings for establishing the electrical connection and air path between the two parts as appropriate. The specific manner by which the cartridge 4 mechanically mounts to the reusable part 2 is not significant to the principles described herein. It will also be appreciated the interface 6 in some implementations may not support an electrical connection between the cartridge 4 and the reusable part 2. For example, in some implementations a vaporizer may be provided in the reusable part 2 rather than in the cartridge 4, or the transfer of electrical power from the reusable part 2 to the cartridge 4 may be wireless (e.g. based on electromagnetic induction), so that an electrical connection between the reusable part 2 and the cartridge 4 is not needed.

Likewise, in normal use, the cartridge 4 and the tobacco pod 8 are releasably coupled together at a second interface 7. The second interface 7 is broadly at the opposite end of the cartridge 4 to the first interface 6. As with the cartridge 4, the tobacco pod 8 is able to be replaced, e.g., when the tobacco material no longer imparts flavor or nicotine to the aerosol generated from the cartridge 4. Providing a tobacco pod 8 which is releasably coupled to the cartridge 4 enables the tobacco pod 8 to be switched independently of the cartridge 4. In this example, the interface 7 provides a structural and air path connection between the cartridge 4 and tobacco pod 8. Any suitable coupling mechanism, such as any of those described above, may be used to couple the tobacco pod 8 to the cartridge 4.

In FIG. 1, the cartridge part 4 comprises a cartridge housing 42 formed of a plastics material. The cartridge housing 42 supports other components of the cartridge and provides the mechanical interface 6 with the reusable part 2. The cartridge housing 42 is generally circularly symmetric about a longitudinal axis along which the cartridge 4 couples to the reusable part 2. In this example the cartridge 4 has a length of around 4 cm and a diameter of around 1.5 cm. However, it will be appreciated the specific geometry, and more generally the overall shapes and materials used, may be different in different implementations.

Within the cartridge housing 42 is a reservoir 44 that, in the described example, contains a liquid aerosol precursor material. The liquid aerosol precursor material may be conventional, and may be referred to as e-liquid. The source liquid may contain nicotine and/or other active ingredients, and/or a one or more flavors. As used herein, the terms "flavor" and "flavorant" refer to materials which, where local regulations permit, may be used to create a desired taste or aroma in a product for adult consumers. In some implementations, the source liquid may contain no nicotine. It should also be appreciated that while the cartridge 4 described above comprises a liquid aerosol precursor material, in other implementations, the aerosol precursor material may be a solid or a gel.

The liquid reservoir 44 in this example has an annular shape with an outer wall defined by the cartridge housing 42 and an inner wall that defines an air path 52 through the cartridge 4. The reservoir 44 is closed at each end with end walls to contain the source liquid. The reservoir 44 may be formed in accordance with conventional techniques, for example it may comprise a plastics material and be integrally molded with the cartridge housing 42.

The cartridge 4 further comprises a vaporizer 48 configured to vaporize the source liquid. The vaporizer in the example of FIG. 1 comprises a heater 48 which is provided in conjunction with a wick 46 located towards an end of the reservoir 44. In this example the wick 46 extends transversely across the cartridge air path 52 with its ends extending into the reservoir 44 of e-liquid through openings in the inner wall of the reservoir 44. The openings in the inner wall of the reservoir are sized to broadly match the dimensions of the wick 46 to provide a reasonable seal against leakage from the liquid reservoir into the cartridge air path without unduly compressing the wick, which may be detrimental to its fluid transfer performance.

The wick 46 and heater 48 are arranged in the cartridge air path 52 such that a region of the cartridge air path 52 around the wick 46 and heater 48 in effect defines a vaporization region for the cartridge 4. E-liquid in the reservoir 44 infiltrates the wick 46 through the ends of the wick extending into the reservoir 44 and is drawn along the wick by surface tension/capillary action (i.e. wicking). The heater 48 in this example comprises an electrically resistive wire coiled around the wick 46. In use electrical power may be supplied to the heater 48 to vaporize an amount of e-liquid (vapor precursor material) drawn to the vicinity of the heater 48 by the wick 46. In this example the heater 48 comprises a nickel chrome alloy (Cr20Ni80) wire and the wick 46 comprises a glass fiber bundle, but it will be appreciated the specific vaporizer configuration is not significant to the principles described herein. Indeed, in other implementations, alternative vaporizers (e.g., a vibrating mesh, LED heaters, etc.) may be used within the cartridge 4. The specific type of vaporizer will be selected based on a number of criteria, including the type of aerosol precursor material to be vaporized. A cartridge which includes a vaporizer is sometimes referred to as a "cartomizer".

The rate at which e-liquid is vaporized by the vaporizer (heater) 48 will depend on the amount (level) of power supplied to the heater 48 during use. Thus electrical power can be applied to the heater 48 to selectively generate vapor from the e-liquid in the cartridge 4, and furthermore, the rate of vapor generation can be changed by changing the amount of power supplied to the heater 48, for example through pulse width and/or frequency modulation techniques.

The tobacco pod 8 in this example is coupled to an end of the cartridge 4 opposite the interface 6. The tobacco pod 8 comprises a pod housing 82 and tobacco material 84 contained within the pod housing 82. The tobacco pod housing 82 is formed from a plastics material. Although not shown, the cartridge 4 may include a recessed feature at the interface 7 into which a part of the tobacco pod 8 is inserted and held by friction fit, or alternatively the tobacco pod housing 82 may include engagement features for coupling to the cartridge 4 via interface 7 (and equally the cartridge 4 is provided with corresponding engagement features for coupling to the tobacco pod housing 82). It should be appreciated that the tobacco pod 8 is directly coupled to cartridge 4 but is indirectly coupled to the reusable part 2 via cartridge 4.

The housing 82 is formed so as to define an inner volume in which the tobacco material 84 can be housed. The housing 82 comprises an inlet 86 in a wall of the housing 82 which fluidly communicates with the air path 52 of the cartridge 4 when the tobacco pod 8 is coupled to the cartridge 4 via interface 7, and an outlet 50 positioned opposite the inlet 86. Air that flows along air path 52 (and in which the vaporized source liquid is entrained) passes into the inner volume of the tobacco pod 8 and interacts with the tobacco material 84. As mentioned above, the tobacco material 84 may impart some flavoring and/or nicotine to the aerosol that enters via inlet 86, and subsequently modifies the composition of the aerosol. The modified aerosol is delivered to the user via outlet 50. During use, the user may place their lips around or adjacent the outlet 86 and draw air through the outlet 50, hence the outlet 50 may be referred to as a mouthpiece outlet 50. The shape and dimensions of the tobacco pod 8 are set such that the housing 82 is broadly flush with the housing 42 when the tobacco pod 8 and cartridge 4 are engaged. In some implementations, the housing 82 of the tobacco pod 8 is shaped for an ergonomic fit with a typical user's mouth, although in other implementations as separate mouthpiece element may be provided which couples to the tobacco pod 8 and/or the cartridge 4.

The reusable part 2 comprises an outer housing 12 with an opening that defines an air inlet 28 for the aerosol provision system 1, a battery 26 for providing operating power for the aerosol provision system 1, a controller (or sometimes referred to as control circuitry) 20 for controlling and monitoring the operation of the aerosol provision system 1, a first user input button 14, a second user input button 24, and an alarm unit 22. The reusable part 2 additionally includes an inhalation sensor (puff detector) 16, which in this example comprises a pressure sensor located in a pressure sensor chamber 18. However, as discussed in more detail below, the pressure sensor is and pressure sensor chamber 18 may not be present in other implementations.

The outer housing 12 may be formed, for example, from a plastics or metallic material and in this example has a circular cross-section generally conforming to the shape and size of the cartridge 4 so as to provide a smooth transition between the two parts at the interface 6. In this example, the reusable part has a length of around 8 cm so the overall length of the e-cigarette when the cartridge part and reusable part are coupled together is around 12 cm. However, and as already noted, it will be appreciated that the overall shape and scale of an electronic cigarette implementing an embodiment of the disclosure is not significant to the principles described herein.

The air inlet 28 connects to an air path 30 through the reusable part 2. The reusable part air path 30 in turn connects to the cartridge air path 52 across the interface 6 when the reusable part 2 and cartridge 4 are connected together. The pressure sensor chamber 18 containing the pressure sensor 16 is in fluid communication with the air path 30 in the reusable part 2 (i.e. the pressure sensor chamber 18 branches off from the air path 30 in the reusable part 2). Thus, when a user inhales on the mouthpiece opening 50, there is a drop in pressure in the pressure sensor chamber 18 that may be detected by the pressure sensor 16 and also air is drawn in through the air inlet 28, along the reusable part air path 30, across the interface 6, through the vapor generation region in the vicinity of the heater 48 (where vaporized e-liquid becomes entrained in the air flow when the heater is active), along the cartridge air path 52, and out through the mouthpiece opening 50 for user inhalation.

The battery 26 in this example is rechargeable and may be of a conventional type, for example of the kind normally used in aerosol provision systems and other applications requiring provision of relatively high currents over relatively short periods. The battery 26 may be recharged through a charging connector in the reusable part housing 12, for example a USB connector. The battery 26 may be, for example, a lithium ion battery.

The user input button 14 in this example is a mechanical button, for example comprising a spring mounted component which may be pressed by a user to establish an electrical contact. In this regard, the input button 14 may be considered to provide a manual input mechanism for the reusable part 2, but the specific manner in which the button is implemented is not significant. For example, different forms of mechanical button or touch-sensitive button (e.g. based on capacitive or optical sensing techniques) may be used in other implementations. The specific manner in which the button is implemented may, for example, be selected having regard to a desired aesthetic appearance.

The user input button 14 in the example of FIG. 1 provides the function of turning the device on and off. When in the on state, power from the battery 26 is provided to the control circuitry 20 and any other components of the reusable part 2 as required, but aerosol generation is not enabled. Rather, the device is in standby with respect to aerosol generation. More specifically, the pressure sensor 16 and control circuitry 20 are provided with power sufficient to enable a detection of a change in pressure (signifying a user inhalation). Once a user inhalation is detected, the control circuitry 20 is configured to supply power to the heater 48 to cause the source liquid to be vaporized. Additionally, once the user inhalation has stopped being detected (e.g., the pressure has dropped below a certain threshold value), then the control circuitry 20 is configured to stop supplying power to the heater 48, resulting in aerosol generation also being stopped. Such aerosol generation activation mechanisms are known, and devices employing such mechanisms are generally referred to as "puff actuated" devices. In alternative configurations that do not employ a pressure sensor 16 (or other inhalation detectors), aerosol generation may be initiated via a user input button. For example, the user input button 14 may provide the dual functionality of turning the device on and off, and enabling aerosol generation. For instance, the user input button 14 may be depressed for a first time period (e.g., 1 second) to turn the device on or off, and when the device is in the on state, the user input button 14 may be held down (depressed) for a second time period greater than the first time period to supply power to the heater 48. When the button is in the depressed state, the user can inhale at the mouthpiece opening 50 to inhale generated aerosol. Such aerosol generation activation mechanisms are known, and devices employing such mechanisms are generally referred to as "button actuated" devices.

The control circuitry 20 is suitably configured/programmed to control the operation of the aerosol provision system 1 to provide functionality in accordance with embodiments of the disclosure as described further herein, as well as for providing conventional operating functions of the aerosol provision system in line with the established techniques for controlling such systems. The control circuitry 20 may be considered to logically comprise various sub-units/circuitry elements associated with different aspects of the aerosol provision system's operation and may be implemented by provision of a (micro)controller, processor, ASIC or similar form of control chip. The control circuitry 20 may be arranged to control any functionality associated with the system 1. By way of non-limiting examples only, the functionality may include the charging or re-charging of the battery 26, the discharging of the battery 26 (i.e., for providing power to the heater 48), in addition to other functionality such as controlling visual indicators (e.g., LEDs)/displays, communication functionality for communicating with external devices, etc. The control circuitry 20 may be mounted to a printed circuit board (PCB). Note also that the functionality provided by the control circuitry 20 may be split across multiple circuit boards and/or across components which are not mounted to a PCB, and these additional components and/or PCBs can be located as appropriate within the aerosol provision device. For example, functionality of the control circuit 20 for controlling the (re)charging functionality of the battery 26 may be provided separately (e.g. on a different PCB) from the functionality for controlling the discharge of the battery 26.

The reusable part 2 further comprises an alarm unit 22 configured to output an alert signal in response to, e.g., an instruction from the control circuitry 20. During use of the aerosol provision system, both the source liquid in the reservoir 44 of the cartridge 4 and the tobacco material 84 of the tobacco pod 8 are consumed in providing an aerosol with certain properties/characteristics of both materials to the user. The quantity of source liquid provided in the cartridge 4 has been carefully selected, primarily with a view to decreasing the cost of goods as much as reasonably possible having regard to certain regulations. Equally, the quantity of tobacco material 84 provided in tobacco pod 8 has been selected based on similar considerations.

However, it has been found that the tobacco pod 8 generally requires replacement more frequently than the cartridge 4 in order to provide a satisfactory aerosol to the user. In other words the tobacco pod 8 generally depletes at a faster rate than the cartridge 4 during normal use. It is difficult for the user to know the ideal time when to switch the tobacco pod 8 for a replacement tobacco pod 8, and it is likely only in response to the user receiving an unsatisfactory aerosol that the user is aware that a tobacco pod requires changing. Depending on the user's levels of perception, the user may not realize this until some time after the ideal time to switch the tobacco pod 8.

Hence, in accordance with the principles of the present disclosure, an aerosol provision system is provided with an alert unit 22 that is configured to output an alert signal to prompt the user to switch the tobacco pod 8. As described in more detail below, the alert signal is output on the basis of the user's usage of the aerosol provision system. The user's usage of the aerosol provision system is to be understood as the usage with respect to generating an aerosol, and not merely any interaction with the system (e.g., usage here does not include the time spent configuring the settings of the system, for instance). That is, usage of the aerosol generation system includes usage of the aerosol provision system that directly results in aerosol generation (sometimes referred to herein as aerosol generation usage).

The control circuitry 20 is configured to monitor the aerosol generation usage of the system 1 and determine when a predetermined usage condition has been met. The predetermined usage condition may be set in advance by the manufacturer or set by a user, but in either case may be stored in a memory which the control circuitry 20 can access. When the predetermined usage condition is met, the control circuitry 20 is configured to cause the alert unit 22 to output an alert signal. The alert unit 22 may include, for example, any one or combination of an optic element (such as an LED), an acoustic element (such as a speaker) and a haptic feedback element (such as a vibrator). In an implementation, the alert unit 22 includes a haptic feedback element configured to output a vibration (or a sequence of vibrations) as an alert signal to prompt the user to switch the tobacco pod 8 when it is determined that the predetermined usage condition has been met based on the user's usage of the aerosol provision system. The alert unit 22 shown in FIG. 1 comprises one or more LEDs. In some implementations, the aerosol provision system 1 may include a display (e.g., a conventional pixelated LCD screen) that is driven to display desired information of various characteristics associated with the aerosol provision system 1, for example current power setting information, remaining battery power, and so forth. The alarm unit 22 may include such a display such that the alert signal is output via the display (e.g., by pulsing the LCD display). The specific implementation of the alert unit 22 is not of primary significance to the principles of the present disclosure.

The alert unit 22 is configured to continuously output the alert signal until a user input is received. It should be appreciated that continuously outputting the alert signal includes outputting a certain signal continuously but also includes continuously outputting an intermittent signal. In other words, LEDs of the alert unit 22 may be continuously illuminated until a user input is received, or the LEDs may be continuously pulsed (e.g., at a fixed or variable frequency) and/or in a certain sequence until a user input is received. Providing a continuous alert signal provides the user with an increased opportunity to perceive the alert signal and act accordingly, e.g., replace the tobacco pod 8. It should also be noted that in some implementations the alert signal is output continuously provided that the device is in an on state. If the device is turned off, or runs out of battery power, the alert unit 22 may not continuously output the alert signal in these implementations due to an absence of power. However, when the device is switched back on, the continuous output of the alert signal is resumed. Therefore, the alert unit 22 in some implementations is configured to continuously output the alert signal, when the aerosol provision system 1 is on, until a user input is received. In other systems the alert signal may not require substantial power to be output, and using a reserve power portion of the battery 26 may enable the alert signal to be continuously output even when the device is switched off.

The control circuitry 20 is configured to monitor for a user input. The user input is for turning off the alert unit 22 (i.e., stopping the output of the alert signal) and/or may be used to reset aspects of the control circuitry 20 (discussed in more detail below). The user input is a specific type of user input, and may include an input from a dedicated input source or an input signal having a certain pattern or taking a certain form.

For example, in FIG. 1, the reusable part 2 includes a second user input button 24, which in this example is distinct from the first user input button 14. The second user input button 24 can therefore be thought of as a dedicated input source. The control circuitry 20 monitors for actuation of the second user input button 24, and when actuation is detected by the control circuitry 20, the control circuitry 20 is configured to cause the alert unit 22 to switch off. The second user input button 24, in this example, is a mechanical button, for example comprising a spring mounted component which may be pressed by a user to establish an electrical contact. In this regard, the input button 24 may be considered to provide a manual input mechanism for the reusable part 2, but the specific manner in which the button is implemented is not significant. For example, different forms of mechanical button or touch-sensitive button (e.g. based on capacitive or optical sensing techniques) may be used in other implementations. The specific manner in which the button is implemented may, for example, be selected having regard to a desired aesthetic appearance.

Alternatively (or additionally), the control circuitry 20 is configured to detect a specific type of input signal from a user input button. For example, in some implementations, user input button 14 is the mechanism by which the user inputs the user input for turning off the alert unit 22. In this instance, to distinguish from an input from user input button 14 to turn on or off the reusable part 2, a user input signal having specific pattern is required to be input via the first user input button 14 to turn off the alert unit 22. For example, the specific input might be two quick button presses (of around 0.5 seconds or less) followed by a third longer button press (of around 2 seconds). In other implementations, a continuous press of the button, e.g., for 20 to 30 seconds, may constitute the specific input. In yet further implementations, the reusable part 2 is configured to give an indication that the user input has been received or is being received. In some implementations, the alert unit 22 is configured to output an indication that the user input has been received or is being received.

The control circuitry 20, when detecting such an input signal from the first input button 14, is subsequently configured to turn off the alert unit 22. In implementations where one user input button 14 is configured to perform multiple functions, it is possible to provide fewer buttons on the outer housing 12 of the reusable part 2. In some implementations, only a single user input button 14 is provided. However, when the number of functions significantly increases, providing multiple user input buttons may reduce the complexity for the user to operate the reusable part 2. Alternatively, a dynamic user input mechanism (e.g., such as a touch-sensitive display screen) may be employed, whereby the touch-sensitive display screen may be configured to change the display image at certain times or in response to certain touches to enable multiple functions to be effected. In other implementations, the user input for turning off the alert unit 22 may be input using an accelerometer (or similar motion sensor) integrated with the aerosol provision system. For example, the control circuitry 20 may include or otherwise be coupled to the accelerometer and, when the accelerometer detects a particular motion or series of motions (e.g., a shaking motion comprising a "forward" and "backward" or "up" and "down" motion), the control circuitry 20 determines that the user input for turning off the alert unit 22 has been received. In some implementations, the use of an accelerometer (or similar motion detecting device) for receiving the user input for turning off the alert unit 22 may be combined with an alert unit 22 comprising a haptic feedback element, which together may be considered as providing a more haptic or physically interactive system.

The control circuitry 20 is configured to detect the user input for turning off the alert unit 22 and, in response to detecting this user input, cause the alert unit 22 to cease outputting the alert signal. The control circuitry 20 may be configured to monitor for the user input for turning off the alert unit 22 (either continuously or intermittently) at all times or only at times when the alert unit 22 is activated (i.e., when the alert unit 22 outputs the alert signal). Configuring the control circuitry 22 to monitor for the user input for turning off the alert signal only when the alert unit 22 is activated may reduce power consumption.

As will be discussed in more detail below, the user input for turning off the alert unit 22 may also be used to reset aspects of the control circuitry 20, and in particular, aspects associated with monitoring the usage of the aerosol provision system 1.

Figure 2:
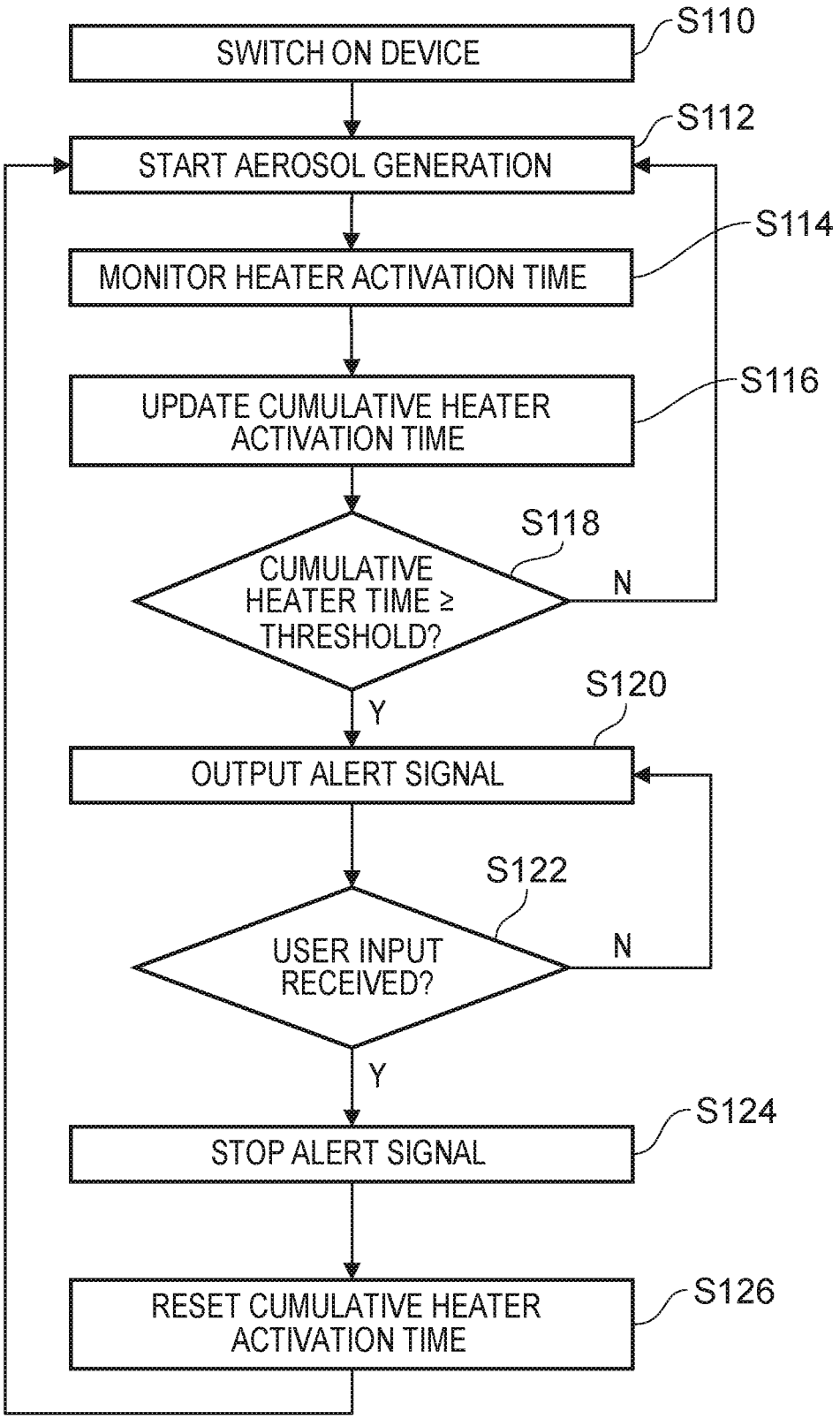
FIG. 2 shows a flow chart depicting an exemplary method for generating an alert signal for alerting the user to change the tobacco pod of the aerosol provision system of FIG. 1.

FIG. 2 is a flow chart depicting an exemplary method of operation of the aerosol provision system 1, and more particularly for outputting an alert signal indicating to the user to change the tobacco pod 8.

The method begins at step S110, when the user switches on the reusable part 2 of the aerosol provision system 1, for example, by using user input button 14 to input a turn on signal which is detected by the control circuitry 20. In response to detecting the turn on signal, the control circuitry 20 supplies power from the battery 26 to other electrical components of the aerosol provision system 1, for example the pressure sensor 16.

At step S112, aerosol generation is started. As discussed above, the reusable part 2 of FIG. 1 includes a pressure sensor 16. When the user inhales at the mouthpiece opening 50 of the aerosol provision system 1, air is drawn from outside the reusable part 2 into the reusable part 2 via air inlet 28. This air flows along air path 30 and subsequently causes a drop in pressure in sensor chamber 18 which is detected by pressure sensor 16. In response to the detection of a reduced pressure, the control circuitry 20 causes power to be supplied to the heater 48 of cartridge 4, which subsequently vaporized the source liquid contained in wick 46. The air is drawn along the reusable part air path 30, across the interface 6, through the vapor generation region in the vicinity of the heater 48 (where vaporized source liquid becomes entrained in the air flow when the heater 48 is active), along the cartridge air path 52, and out through the mouthpiece opening 50 for user inhalation. As mentioned previously, however, the aerosol may be generated using puff actuation mechanisms as just described and/or using button actuated mechanisms depending upon the application at hand.

In response to starting aerosol generation, the control circuitry 20 is configured at step S114 to begin monitoring the usage of the aerosol provision system 1 to generate an aerosol (referred to herein as aerosol generation usage). In the present example, the control circuitry 20 is configured to determine the duration for which the heater 48 is activated and hence generating aerosol from source liquid. For example, the control circuitry 20 is configured to determine the length of time that power is supplied to the heater 48 (or conversely the length of time for which the pressure sensor 16 detects a drop in pressure). In this instance, the control circuitry is configured to determine the start and end of aerosol generation, so as to be able to calculate the heater activation duration. Techniques for determining the start and end of an inhalation are not discussed in any great detail herein, and any suitable technique could be employed by the skilled person. The control circuitry 20 is configured to determine the heater activation time for each instance of aerosol generation (which may also be referred to herein as one inhalation).

The control circuitry 20 is configured to store a cumulative aerosol generation usage parameter for multiple uses of the aerosol provision system 1. The cumulative aerosol generation parameter is a parameter which represents a cumulative measure of the aerosol generation undertaken by the aerosol provision system 1. The cumulative aerosol generation parameter in the specific example includes a cumulative heater activation time, i.e., the length of time the heater 48 has been active. However, it should be appreciated that other parameters that can represent the amount of aerosol generation performed by aerosol provision system 1 may alternatively be used. The cumulative heater activation time is stored in a memory (not shown). At step S116, after one inhalation has finished, the control circuitry 20 is configured to update the cumulative heater activation time stored in the memory to include the heater activation time for that inhalation. In other words, after one inhalation, the memory is updated such that a new value for the cumulative heater activation time is stored in the memory. The new value is calculated by adding the previously stored value and the heater activation time for the current inhalation. Before first use of the reusable part 2 with a first cartridge 4, the cumulative heater activation time is set to zero in the memory.

At step S118, the control circuitry 20 is configured to determine when a predefined usage condition has been met. More specifically, the control circuitry 20 is configured to compare the cumulative aerosol generation usage parameter to a threshold. The threshold may be a time value, e.g., a certain number of seconds or minutes. In the system 1 of FIG. 1, in which a cartridge 4 comprising an e-liquid and a tobacco pod 8 comprising a tobacco material are used to provide an aerosol to the user, the threshold is set to between 170 to 300 seconds, or between 180 and 290 seconds. In a specific implementation, the threshold is set to 280 seconds. It has been found that a threshold as defined above is long enough for ensuring sufficient usage of the tobacco material within the tobacco pod 8 for modifying the aerosol, but at the same time short enough to ensure that an unsatisfactory aerosol is not provided to a user. It should be appreciated however that the specific threshold may vary from the above in accordance with the type of tobacco material (or more generally the type of aerosol modifying material), the type of source liquid (or more generally the aerosol precursor material), and the amount of aerosol generated per inhalation from the aerosol precursor material (which may be dependent on the power supplied to the heater 48, for example), amongst other factors. More generally, the threshold for step S118 can be set at less than or equal to one half of the total cumulative time the heater is activated for the cartridge 4 containing between 1.5 to 2.5 ml of liquid to be depleted, to greater than or equal to one quarter of the total cumulative time the heater is activated for the same cartridge 4. The control circuitry 20 is configured to compare the cumulative heater activation time to the threshold time value. If the cumulative heater activation time is less than (or in some implementations less than or equal to) the threshold (i.e., "NO" at step S118), then the method proceeds back to step S112 where the next inhalation is started. Conversely, if the cumulative heater activation time is greater than or equal to (or in some implementations just greater than) the threshold (i.e., "YES" at step S118), then the method proceeds to step S120.

It should be appreciated that in alternative implementations, any suitable way of recording the cumulative usage of the tobacco pod 8 may be implemented. For example, the initial value of the cumulative heater activation time may be set at the threshold value (e.g., 280 second) and with each inhalation, the heater activation time for that inhalation value is subtracted from the cumulative heater activation time until the cumulative heater activation time reaches zero. In essence, any algorithm that can be used to record usage of the tobacco pod 8 may be used in accordance with the principles of the present disclosure.

At step S120, the control unit 20 is configured to cause the alert unit 22 to output the alert signal. As mentioned, the alert unit 22 may be at least one of an optic element (such as an LED), an acoustic element (such as a speaker) and/or a haptic feedback element (such as a vibrator). Accordingly, the alert signal is any suitable signal that can be generated by these elements to output an optical signal, an acoustic signal, or a haptic feedback signal (or any combination thereof). The alert signifies to the user that a predetermined usage condition has been met and, in this example, that the tobacco pod 8 should be switched with a fresh tobacco pod 8.

In the aerosol provision system of FIG. 1, the alert signal is continuously output until a user input (e.g., via the second user input button 24) is received. By continuously outputting the alert signal, the user has a greater opportunity to observe the alert signal and to realize that the tobacco pod 8 requires changing. This may be particularly useful when the alert unit 22 forms part of the reusable part 2, as during use, the reusable part 2 spends periods of time close to the user's face (e.g., during inhalation) and/or may be orientated in normal use with the alert unit 22 directed away from the user's line of sight. In one particular implementation, the alert unit 22 is formed of four LEDs provided in a sequential arrangement on the surface of the outer housing 12 of the reusable part 2. For example, the LEDs may be arranged in an annular shape where each LED illuminates one quarter of the annular shape. The alert signal in this instance includes continuously pulsing or flashing the first (top left) and fourth (top right) LEDs of an annular arrangement of four LEDs. Note here that the "top left" and "top right" are used purely to distinguish the quadrants that are illuminated and is not intended to infer any particular orientation of the four LEDs when present on the reusable part 2. That is, the term "top" may refer to a half of the annular arrangement of the LEDs closer to the mouthpiece outlet 50 than the distal (opposite) end of the reusable part 2, or conversely the half closer to the distal end than the mouthpiece outlet 50. Any suitable arrangement could be employed by the skilled person. In some further implementations, alert unit may be configured to output optical signals having different colors. For example, the LEDs may be arranged to flash blue in the event that the alert signal indicating the tobacco pod requires changing is output.

It should also be appreciated that the alert unit 22 may also be configured to provide other alert signals to the user that are not representative of the need to change the tobacco pod 8; for example, a low power alert signal signifying that the battery 26 is low on power may additionally be conveyed through the alert unit 22.

It should also be understood that, unlike with the cartridge 4 which includes a liquid reservoir 44 containing source liquid and a heater 48, the tobacco pod 8 may still continue to be used by a user to generate modified aerosol. For example, when the source liquid within the reservoir 44 is depleted, or almost deleted, such that the wick 46 contains a lower amount of liquid than during normal use, continuing to supply power to the heater 48 can caused undesired effects such as charring of the material or the wick 46, or burning of the remaining source liquid (as the heater temperature may increase when the volume of liquid being heated is lower than normal), which can lead to generation of an unsatisfactory aerosol in addition to potentially causing damage to the cartridge 4 and/or the reusable part 2. These effects can sometimes be quite quick to develop. That is, within only a few puffs the cartridge 4 can go from generating normal aerosol to unsatisfactory aerosol. Conversely, the decline of the quality of the aerosol that is modified by the tobacco pod 8 may be more gradual. Equally, passing the aerosol through the tobacco pod 8 will, usually, not lead to any damage to the cartridge 4, tobacco pod 8, or reusable part 2. Therefore in accordance with the principles of the present disclosure, it is possible to continue to generate aerosol using the aerosol provision system 1 even when the alert unit 22 is outputting an alert signal signifying that the user should change the consumable part or a part thereof (e.g., the tobacco pod 8).

Accordingly, at step S122, the control unit 22 is configured to detect whether or not a user input for turning off the alert signal has been received. Once the user observes the alert signal, the user normally changes the tobacco pod 8 for a fresh tobacco pod 8, and subsequently provides the user input to turn off the alert unit 22 (e.g., via user input button 24). Assuming the user proceeds in this way, the control circuitry 20 detects the user input for turning off the alert unit 22 at step S122 (i.e., "YES" at step S122) and proceeds to step S124. At step S124, the alert unit 22 is switched off, e.g., in response to a control signal from the control circuitry 20.

In some instances, at step S122, the user input will not be received (i.e., "NO" at step S122). In these cases, the control circuitry 20 may be configured to continue causing the alert unit 22 to output the alert signal until a user input for turning off the alert signal has been received. In this case, the method proceeds back to step S120. The control circuitry 20 may be configured to periodically check as to whether or not the user input has been received (e.g., the control circuitry may check at a rate of once every 20 ms). Although not shown in FIG. 2, in some instances the user may perform another inhalation while the alert signal is being output by the alert unit 22. In this instance, the method may proceed back to step S112 and the cumulative heater activation time is updated as described. Alternatively, the control circuitry 20 may not update the cumulative heater activation time when the alert signal is being output even for subsequent inhalations until such a time as the user input for turning off the alert signal is received.

At the same time as or after step S124, the control circuitry 20 is configured to reset the cumulative heater activation time (as shown at step S126). In other words, the control circuitry 22 is configured to delete or overwrite the previously stored value for the cumulative heater activation time, essentially resetting the cumulative heater activation time to zero. Hence, during subsequent inhalations, in which the fresh tobacco pod 8 is used to modify the aerosol generated by the cartridge 4, the cumulative heater activation time corresponds to the usage of the fresh tobacco pod 8.

Accordingly, the method described by FIG. 2 enables a user of the aerosol provision system 1 to continuously receive an alert signal alerting the user to the fact that the tobacco pod 8 requires switching with a fresh tobacco pod 8, and that the alert signal is not switched off until an appropriate user input has been received corresponding to a user switching the tobacco pod 8. As described, the method permits generation of aerosol even when the alert signal is currently being output, meaning that the user is not inconvenienced should a fresh tobacco pod 8 not be immediately to hand. Also, by continuously outputting the alert signal, the user is not tempted to simply turn off the alert should a tobacco pod 8 not be immediately to hand, thereby increasing the chances of a user forgetting to change the tobacco pod 8 and increasing the chances of a user experiencing an unsatisfactory aerosol. Moreover, when the user input is received, a counter or cumulative usage indicator is automatically reset meaning that broadly consistent experiences are provided to the user when switching tobacco pods 8.

Although it has been described above that the aerosol generation usage parameter is a time period for which the heater is activated, it should be appreciated that any suitable parameter which can be used to indicate or measure the usage of the aerosol provision system 1 to generate aerosol can also be used within the principles of the present disclosure. For example, rather than measure the heater activation time, the control circuitry 20 may be configured to count the number of inhalations (or the number of times the heater is activated). This may be referred to as the "number of puffs". The cumulative number of puffs is stored in the memory and, in this implementation, the stored value is increased by one for each detected puff. The threshold in this implementation is correspondingly set to a number of puffs, say 90 to 100, although the actual value will vary in accordance with the aerosol precursor material used, the aerosol modifying material, etc. as described above.

As described above, the tobacco pod 8 is a plastic housing that couples, physically and via the air flow channel, to the cartridge 4. In some implementations, however, the tobacco pod 8 may be electrically coupled to the reusable part 2 via interface 6 and interface 7. For example, electrical connections may run along the length of the cartridge 4 and be arranged to couple to respective electrical contacts on the reusable part 2 and the tobacco pod 8 at interfaces 6 and 7 respectively. More specifically, at interface 6, the reusable part 2 may comprise two separate electrical contact pads, while at interface 7, the tobacco pod 8 may comprise two separate electrical contact pads coupled by a wire or other conductive element. The tobacco pod 8 can therefore be brought into electrical contact with the reusable part 2 via the cartridge 4 to form an electrical circuit. The reusable part 2 (or more specifically the control circuitry 20) may be configured to monitor the resistance between the electrical contacts of the reusable part 2. When the tobacco pod 8 is electrically coupled to the contacts of the reusable part 2, the resistance between the contacts of the reusable part will change (the resistance will go from a very high value signifying an open circuit when the tobacco pod is not electrically coupled to a lower value signifying a closed circuit when the tobacco pod is electrically coupled to the reusable part 2). The user input for turning off the alert in such implementations is input by decoupling a first tobacco pod 8 from the cartridge 4 and then coupling a second tobacco pod 8 to the cartridge 4. That is, the user input signal is a change in measured resistance resulting from the user physically separating the tobacco pod from the cartridge 4

(and/or reusable part 2). Other electrical parameters may be measured in a corresponding manner.

In such implementations, the tobacco pod 8 may also be provided with an identification element (such as a digital chip) coupled between the electrical contacts of the tobacco pod and which can be read to provide a unique identifier for the tobacco pod 8. The reusable part 2 may store the read identifier in association with the cumulative aerosol usage parameter. Accordingly, the memory may store a plurality of identifiers each in association with a corresponding cumulative aerosol generation usage parameter. When receiving the user input to turn off the alert signal, the control circuitry 20 is configured to read the identifier of the currently coupled tobacco pod 8 and identify whether the identifier is stored in the memory. If it is not, the control circuitry 20 stores the unique identifier in combination with an initial value for the aerosol usage generation parameter and the process according to FIG. 2 is implemented. If the unique code is stored within the memory, the control circuitry is configured to perform step S118 using the stored value of the cumulative aerosol generation usage parameter. This approach may prevent users from simply disconnecting and reconnecting the same tobacco pod 8 once the alert signal is being output, as this will continue to output the alert signal even after disconnection and reconnection. The principle of using a unique identifier for each tobacco pod 8 is also applicable where the user input for turning off the alert unit 22 is not disconnection and reconnection of the tobacco pod 8 (for example, the same principles can be applied even if the user input signal is received via user input button 24).

As an alternative to providing an electrical coupling between the tobacco pod 8 and the reusable part 2, the reusable part 2 may instead be provided with a wireless reader configured to wirelessly read a wirelessly-readable element located on the tobacco pod 8. In one example, the wireless reader is an RFID reader, and the wirelessly-readable element is an RFID tag. The wireless-readable element may be readable only in the context of being detectable (i.e., providing no other information of the tobacco pod), or may provide a unique code identifying the tobacco pod 8 as described above.

In some implementations, the tobacco pod 8 may also include a heater element (or other vaporizer) configured to energize the tobacco material stored within the tobacco pod 8. When the tobacco pod 8 is electrically coupled to the reusable part 2, power may be supplied to the tobacco pod 8 from battery 26 under to control of control circuitry 20. Engergizing the tobacco material may help to increase the flavor and/or actives that are released from the tobacco material and subsequently entrained in the aerosol. The extent of energization may depend on the type of tobacco material in addition to other factors.

In the aerosol provision system 1 shown in FIG. 1, both a replaceable cartridge 4 and a replaceable tobacco pod 8 are used to generate the aerosol that is delivered to the user. As described above, these two consumable parts may deplete at different times during use of the aerosol provision system 1.

Figure 3:
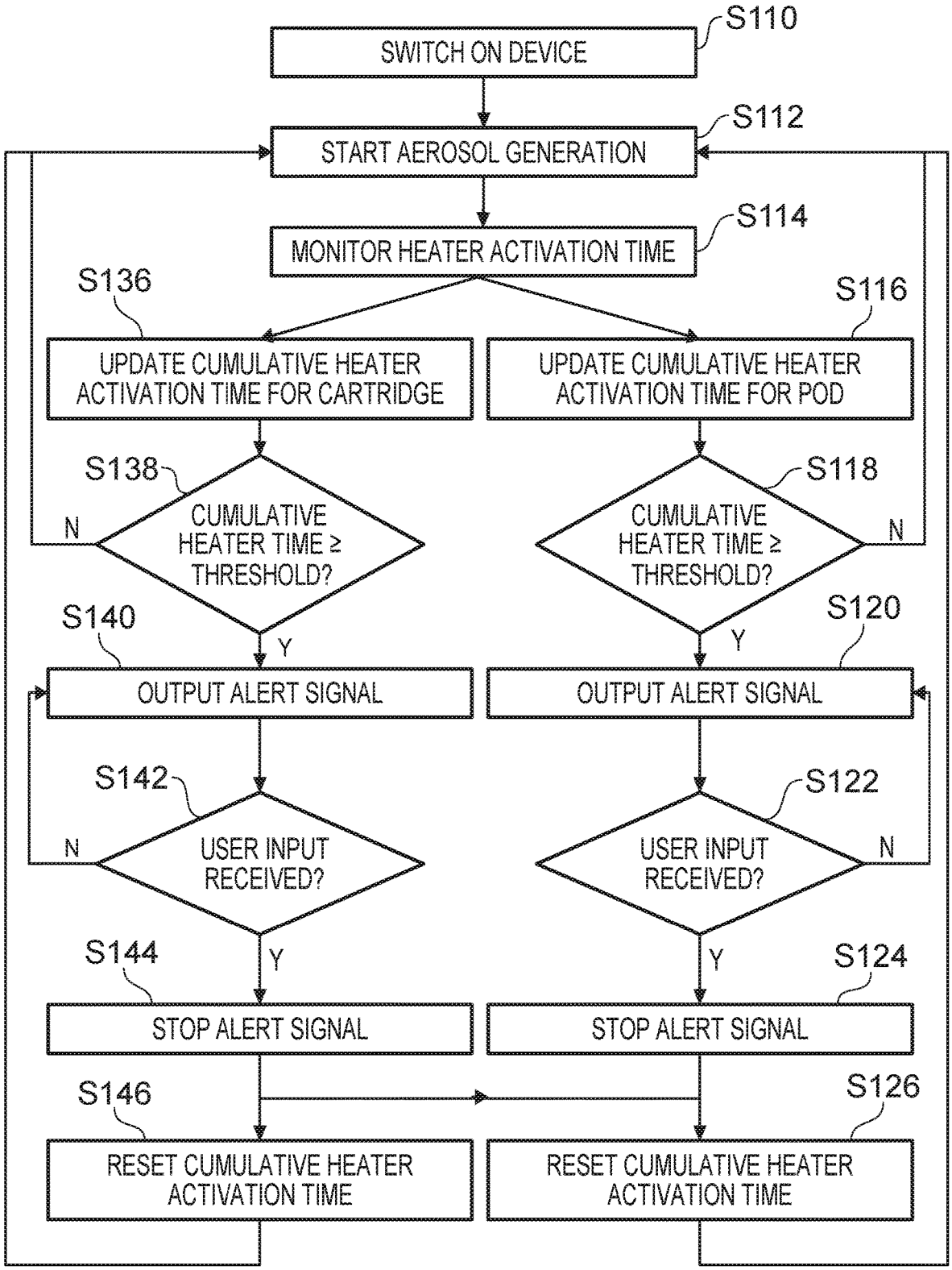
FIG. 3 shows a flow chart depicting an exemplary method for generating alert signals for alerting the user to change the tobacco pod and the cartridge of the aerosol provision system of FIG. 1.

FIG. 3 is an example method in which the user is alerted of the need to change one or both of the tobacco pod 8 and the cartridge 4. Steps that are the same or broadly the same as those described in relation to FIG. 2 are given the same reference signs and a detailed description thereof is omitted here for conciseness.

The method of FIG. 3 starts at step S110 in which the reusable part 2 is turned on, and proceeds to step S112 in which an inhalation (i.e., an instance of aerosol generation) starts as described in FIG. 2. The control circuitry 20 is also configured to monitor usage at step S114 as described in FIG. 2.

However, in contrast to FIG. 2, the method of FIG. 3 differs in that not only is a cumulative aerosol generation usage parameter updated for the tobacco pod 8 at step S116, but additionally a cumulative aerosol generation usage parameter for the cartridge 4 is updated at step S136. Taking the example described with respect to FIG. 2, the memory is configured to store a first cumulative heater activation time for the tobacco pod 8 and a second cumulative heater activation time for the cartridge 4. Hence, after every inhalation, the control circuitry is configured to update the first cumulative heater activation time for the tobacco pod 8 (in accordance with step S116) and to update the second cumulative heater activation time for the cartridge 4 (in accordance with step S136). Step S136 is broadly similar to step S116 in terms of how the cumulative heater activation time is updated. When both the tobacco pod 8 and the cartridge 4 have not been used previously with the reusable part 2, the cumulative heater activation times are updated in correspondence with one another.

Steps S118, S120, S122, S124, and S126 are identical to those described in relation to FIG. 2.

After step S136, the control circuitry 20 is configured to determine when a predefined usage condition for the cartridge 4 has been met. More specifically, the control circuitry 20 is configured to compare the cumulative aerosol generation usage parameter to a threshold. The threshold may be a time value, e.g., a certain number of seconds or minutes. However, the threshold for determining a predefined usage condition for the cartridge 4 is different to the threshold for determining a predefined usage condition for the tobacco pod 8. More specifically, when the threshold is a time value, it has been found that a suitable threshold for the cartridge is between two to four times that for the tobacco pod 8. For example, the time value for the threshold for the cartridge is set to between 340 to 600 seconds, or between 360 and 580 seconds. In a specific implementation, the threshold is set to 560 seconds. It should be appreciated however that the specific threshold may vary from the above in accordance with the type of aerosol precursor material and the amount of aerosol generated per inhalation from the aerosol precursor material (which may be dependent on the power supplied to the heater 48, for example), amongst other factors.

At step S138 the control circuitry is configured to compare the cumulative heater activation time for the cartridge 4 to the threshold time value for the cartridge. If the cumulative heater activation time is less than (or in some implementations less than or equal to) the threshold (i.e., "NO" at step S138), then the method proceeds back to step S112 where the next inhalation is started. Conversely, if the cumulative heater activation time is greater than or equal to (or in some implementations just greater than) the threshold (i.e., "YES" at step S138), then the method proceeds to step S140. As discussed in relation to step S118, it should be appreciated that in alternative implementations, any suitable way of recording the cumulative usage of the cartridge 4 may be implemented.

At step S140, the control unit 20 is configured to cause the alert unit 22 to output an alert signal. The alert signal 22 may be the same or a different signal as output in step S120. In the implementation described where the alert unit 22 is formed of four LEDs provided in a linear arrangement on the surface of the outer housing 12 of the reusable part 2, the alert signal output at step S140 in this instance includes constantly illuminating the second and third LEDs of the linear arrangement. In this example, the alert signal output at step S120 and the alert signal output at step S140 are complementary (i.e., both can be output simultaneously if the various usage conditions are simultaneously met), but this does not have to be the case. In some implementations, the alert signal output by step S140 may take priority over the alert signal output by step S120.

In addition to outputting the alert signal at step S140, when the control circuitry 20 determines that the predetermined usage condition for the cartridge 4 has been met at step S138, the control circuitry 20 is configured to prevent power being supplied to the heater 48. It should be appreciated that unlike the predetermined usage condition at step S118 which permits the tobacco pod 8 to continue to be used, the predetermined usage condition at step S138 signifies that the cartridge 4 is depleted or nearly depleted of source liquid, and as such it is no longer suitable to generate aerosol. Accordingly, not only is the user provided with an alert signal signifying the cartridge 4 should be changed, but the aerosol generation system 1 is prevented from generating aerosol even if the user inhales on the system 1 and the pressure sensor 16 detects a sufficient drop in pressure.

The alert signal output at step 140 may or may not be continuously output given that the user is prevented from inhaling aerosol. It may be advantageous to continuously output the alert signal to avoid confusion with other operational factors, e.g., faulty or damaged electrical components, etc. that may prevent aerosol generation.

At step S142, the control unit 22 is configured to detect whether or not a user input for turning off the alert signal and/or for re-enabling aerosol generation has been received. This user input may be provided via the second user input button 24, or any other user input mechanism as discussed above in relation to the tobacco pod 8. For cartridges 4 that are electrically coupled to the reusable part 2, a particularly suitable user input is the decoupling and recoupling of the cartridge 4. As with the tobacco pod 8, the cartridge 4 may be provided with an identification element, and or a wirelessly-readable element, to help avoid the user simply recoupling the same used cartridge 4. That is, the user input to be received at step S142 for turning off the alert signal signifying the cartridge 4 should be replaced may also be a decoupling/re-coupling of the cartridge 4.

In one implementation, the user input is received via the input button 14. The specific user input for turning off the alert signal in this implementation is a continuous button press for a total of 30 seconds. In this embodiment, the alert unit 22 is configured to output an indication that the specific user input is being received. When the user first presses the input button 14, the alert unit 22 which comprises, e.g., four LEDs in an annular arrangement, is switched off for a period of five seconds. After the first five seconds of a continuous 30 second press, one of the LEDs is illuminated for another five seconds. After the second five seconds (i.e., 10 seconds from the start of the press), a second LED is illuminated for another five seconds. After the third five seconds (i.e., 15 seconds from the start of the press), a third LED is illuminated for another five seconds. After the fourth five seconds (i.e., 20 seconds from the start of the press), a fourth LED is illuminated for another five seconds. At this point, which is 25 seconds from the initial detection of the user input, all four LEDs are turned on. This may continue for a further five seconds, at which point four LEDs may sequentially be flashed in a clockwise or anticlockwise direction, indicating that the specific input has been received. At this point the user can release the button 14, and subsequently the control circuitry 22 is configured to turn off the alert unit 22. It should be appreciated that, if at any point before the 30 seconds if the user releases button 14, the alert signal resumes outputting the alert signal indicating that the cartridge 4 requires changing. It should be appreciated that this is one example arrangement as to how the alert unit 22 can signify that a specific user input is being received. The LEDs (or more generally the alert unit 22) may be activated according to any suitable pattern or to provide any suitable signal that can be interrupted by the user as the device receiving the specific input.

Assuming the control circuitry 20 detects the user input for turning off the alert unit 22 at step S142 (i.e., "YES" at step S142), the method proceeds to step S144. At step S144, the alert unit 22 is switched off, e.g., in response to a control signal from the control circuitry 20 and/or aerosol generation is re-enabled. In some instances, at step S142, the user input will not be received (i.e., "NO" at step S122), which means the control circuitry 20 will continue to prevent generation of aerosol and, if appropriate, may cause the alert signal to continue to be continuously output. The control circuitry 20 may be configured to periodically check as to whether or not the user input has been received (e.g., the control circuitry may check at a rate of once every 20 ms).

At the same time as or after step S144, the control circuitry 20 is configured to reset the cumulative heater activation time for the cartridge 4 (as shown at step S146). In other words, the control circuitry 22 is configured to delete or overwrite the previously stored value for the cumulative heater activation time for the cartridge 4, essentially resetting the cumulative heater activation time for the cartridge 4 to zero. Hence, during subsequent inhalations (i.e., when the method returns to step S112), in which a fresh cartridge 4 is used, the cumulative heater activation time corresponds to the usage of the fresh cartridge 4.

In some implementations, and as shown in FIG. 3, when the control circuitry 20 detects the user input at step S142 and subsequently resets the cumulative heater activation time for the cartridge 4 at step S146, the control circuitry 20 is also configured to reset the cumulative heater activation time for the tobacco pod 8 at step S126. This is because it is found that it is likely for a user to replace the cartridge 4 and tobacco pod 8 simultaneously when the cartridge 4 is determined to meet a predetermined usage condition for the cartridge 4, even if the tobacco pod 8 has not met a predetermined usage condition for the tobacco pod 8. Accordingly, in these implementations, it is assumed that a fresh tobacco pod 8 is used when a fresh cartridge 4 is coupled to the reusable part 2. That is, in such an implementation, the control circuitry 20 is configured to interpret a user input when the predetermined usage condition for the tobacco pod 8 has been met as an instruction to reset the cumulative heater activation time for the tobacco pod 8, and the control circuitry 20 is configured to interpret a user input when the predetermined usage condition for the cartridge 4 has been met as an instruction to reset the cumulative heater activation time for the cartridge and an instruction to reset the cumulative heater activation time for the tobacco pod 8.

In conjunction with the above, it should also be appreciated that the steps associated with the tobacco pod 8 (i.e., steps S116 to S126) occur in parallel to the steps associated with the cartridge 4 (i.e., steps S136 to 146). Initially, when the cartridge 4 and the tobacco pod 8 are both fresh, the cumulative heater activation times at steps S116 and S136 will be updated similarly until the cumulative heater activation time for the tobacco pod 8 is greater than (and/or equal to) the threshold for the tobacco pod 8; that is, up until step S118 outputs a "YES". As mentioned above, this is because the threshold for the tobacco pod 8 is set to be lower than the threshold for the cartridge 4. At this time, the alert signal at step S120 is output. The cumulative heater activation time for the cartridge 4 continues to be updated even when the alert signal at step S120 is output should the user continue to inhale on the system 1. When the user inputs the user input for turning of the alert signal at step S122, the alert signal indicating that the tobacco pod 8 requires changing is switched off at step S124 and the cumulative heater activation time is reset at step S126. However, it should be appreciated that the cumulative heater activation time for the cartridge 4 is not reset at this time.

Therefore, in some implementations, the control circuitry 20 is configured to determine when predetermined usage conditions have been met for both the cartridge 4 and tobacco pod 8 of the consumable part of an aerosol provision system 1, and provide alert signals signifying to the user to change one or both of the cartridge 4 and tobacco pod 8.

It should be appreciated that, in some implementations, outputting the alert signal and stopping power to the heater as described at step S140 in FIG. 3 may be separate actions in the method. For example, in some implementations, the threshold used in step S138 is set at a lower value, for example at 520 s as opposed to 560 s. This means that when the alert signal is output, there is a quantity of source liquid remaining in the reservoir 44. The alert signal is output at step S140 but such an alert signal signifies to the user that the cartridge is running low and requires replacement soon, but still enables the user in generate aerosol from the cartridge 4. That is, even when the alert signal is being continuously output by alert unit 22, the user is able to generate and inhale aerosol. At a later time, e.g., after at least one further inhalation, the control circuitry 20 is configured to compare the cumulative heater activation time with a further threshold, e.g., a threshold of 560 s. At this point, if the cumulative heater time is greater than (and/or equal to) the further threshold, the control circuitry 20 is configured to stop the supply of power to the heater 48. It should be appreciated that the principles of alert signal as described in steps S136 to S146 and the modified version as described in this paragraph may be applied to aerosol provision systems 1 including a cartridge 4 but that do not contain a tobacco pod 8 (or aerosol modifying material pod).

While it has been described that the cartridge 4 is releasably coupled to the reusable part 2, in some implementations, the cartridge 4 may be integrated with the reusable part 2. For instance, the cartridge housing 42 is formed in conjunction with, or is the same as, the outer housing 12 of reusable part 2. In such implementations, the liquid reservoir 44 may be refilled with source liquid when the reservoir 44 is depleted, for example via a closable opening into reservoir 44. In such implementations, the alert signal may indicate to the user that reservoir 44 is depleted and requires refilling (as opposed to replacing the detachable cartridge 4 as described above).

Figure 4:
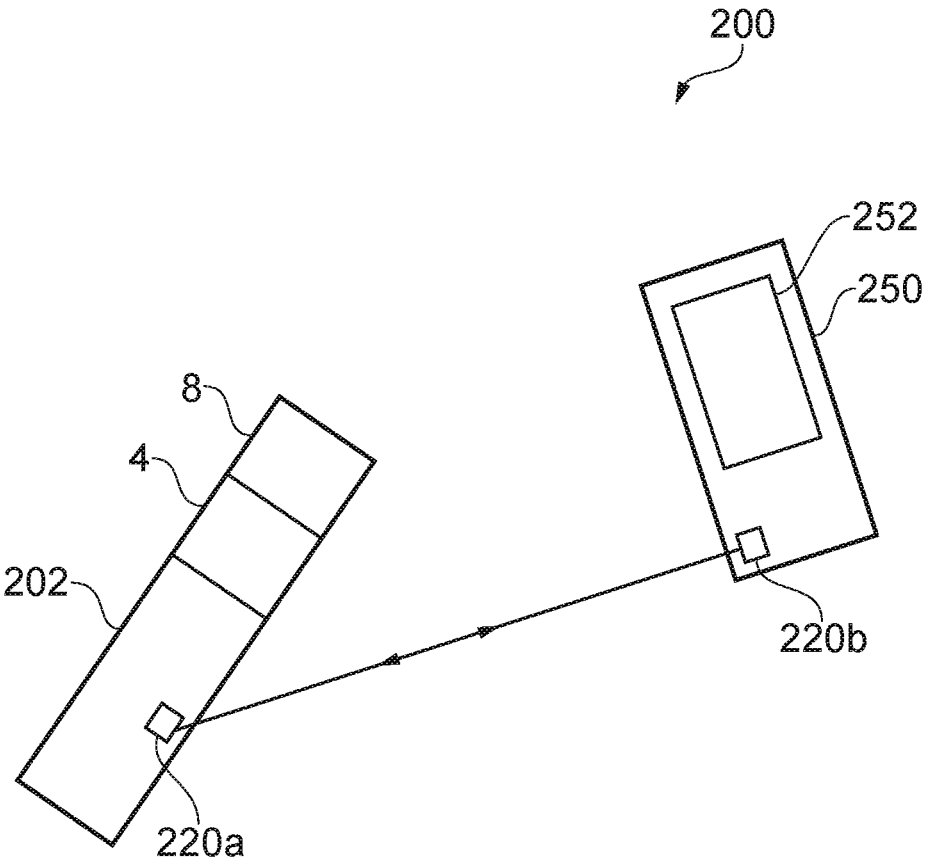
FIG. 4 schematically represents an aerosol provision system in accordance with aspects of the present disclosure in which the control circuitry is split across multiple remote devices.

It has generally been described above that the aerosol provision system 1 is formed of a reusable part 2 and a consumable part and that the control circuitry 20 and alert unit 22 form part of the reusable part 2. However, in some implementations, the control circuitry 20 and/or alert unit 22 are located in a separate entity, for example, a smartphone or similar remote computing device. FIG. 4 is an example of such an implementation. FIG. 4 shows an aerosol provision system 200 which comprises a reusable part 202, a cartridge 4, tobacco pod 8, and smartphone 250. The cartridge 4 and tobacco pod 8 are substantially the same as those described above in relation to FIGS. 1 to 3. The reusable part 202 is largely the same as reusable part 2 and to avoid repetition, only features that are different will be described herein.

Reusable part 202 comprises control circuitry 220*a* which is similar to control circuitry 20 described in FIG. 1. However, as described with respect to control circuitry 20, the control circuitry 20 may comprise different physical components (i.e., PCBs) for different functions. In this instance, smartphone 250 comprises control circuitry 220*b* which is configured to perform the functions of determining when the predetermined usage condition has been met and is configured to cause the alert unit to output the alert signal. Conversely, the control circuitry 220*a* in the reusable part 202 is configured to perform the function of monitoring the usage of the reusable part 202 for generating aerosol (amongst other functions). One additional function of control circuitry 220*a* and 220*b* (that was not explicitly mentioned in the context of control circuitry 20 but may nevertheless be present in reusable part 2) is the function of transmitting and receiving data. More specifically, control circuitry 220*a* is configured to transmit the monitored usage data to the receiver part of control circuitry 220*b*, while control circuitry 220*b* is configured to transmit data (e.g., such as control signals) to the reusable part 202.

In the example described in FIG. 4, the reusable part 202 does not comprise an alert unit. Instead, the alert unit is realized via the smartphone, for example using a touch-sensitive display 252 of the smartphone 250. When an inhalation has finished, control circuitry 220*a* transmits the usage data (e.g., the heater activation time) to the smartphone 250. That is, the reusable part is configured to perform step S114 of FIG. 2 or FIG. 3, and subsequent to step S114, transmit the usage data to the remote computing device (e.g., smartphone 250). Control circuitry 220*b* of the smartphone 250 receives the usage data and proceeds to add the usage data to the cumulative heater activation time which may be stored in memory of the smartphone. That is, the smartphone performs step S116 and/or step S136 of FIGS. 2 and 3. The control circuitry 220*b* of the smartphone then compares the cumulative heater activation time to the corresponding threshold (steps S118 and/or S138), and determines whether or not to output the alert signal at step S120 and/or step S140 using an alert unit of the smartphone, e.g., display 252. For example, the alert signal may be a flashing text alert on the display 252. The control circuitry 220*b* may then monitor for a user input received via the smartphone 250, e.g., a touch detected via the touch-sensitive display 252, at steps S122 and/or S142. Correspondingly, the control circuitry 220*b* is configured to turn off the alert signal at steps S124 and/or S144, and to reset the cumulative heater activation time at steps S124 and/or S144.

Such an implementation may be useful in cases where the reusable part 202 does not have an alert unit 22 and/or does not have the processing power or memory availability to perform the more computer resource intensive processing steps. Of course, it should be appreciated that in alternative implementations, the reusable part may comprise an alert unit and, in this instance, the remote computing device may simply transmit an instruction to output the alert signal to the reusable part. The user input may subsequently be received via the reusable part or the remote computing device. It should also be appreciated that the remote computing device may include a server accessible via a network (e.g., the internet).

Although it has been described above that the alert unit 22 outputs an optic, acoustic or haptic signal to indicate to the user that the tobacco pod 8 and/or cartridge 4 requires changing, in some implementations, the alert signal can be supplemented by actively altering the aerosol generated and delivered to a user. For instance, in one implementation, when the control circuitry 20 determines that the predetermined usage condition has been met, the control circuitry 20 causes the alert unit 22 to output the alert signal and is also configured to supply power to the heater 48 for generating of the aerosol from the aerosol precursor material at a lower or reduced amount, but an amount still sufficient to generate aerosol, as compared to when the control circuitry 20 determines that the predetermined usage condition has not been met. This has the effect that the user additionally perceives a deliberate change in the aerosol that is produced, and in particular, a reduction in the volume of aerosol generated as a result of reducing the power supplied. The actual numerical value of reduced power supplied may depend on a number of factors. In one implementation, the power is reduced, e.g., halved, as compared to a normal operating mode, which has the effect that the volume of aerosol produced is lower, as described above. In other implementations, the power can be reduced such that aerosol is still being generated, but the volume is relatively low such that the generated aerosol is difficult to perceive by the user (in other words, the density of aerosol exhaled by the user after inhalation is low). The skilled person would be aware of ways of varying the power to affect the level of aerosol produced. Other effects such as altering the taste (e.g., by vaporizing a different flavored source liquid) which prompt the user into perceiving a change in the aerosol may also be employed. In some instances, the alert signal may be provided only by adjusting the volume and/or taste of the aerosol.

Thus, there has been described an aerosol provision system for generating aerosol from an aerosol precursor material, the system comprising a consumable part for generating aerosol that is to be provided to a user of the aerosol provision system; a reusable part configured to enable generation of aerosol from an aerosol precursor; control circuitry configured to monitor usage of the aerosol provision system; and an alert unit configured to output an alert signal, wherein the control circuitry is configured to determine when a predetermined usage condition has been met, and in response to determining that the predetermined usage condition has been met, to cause the alert unit to output an alert signal, wherein the alert unit is configured to cease output of the alert signal in response to a user input. Also described is a method of generating an alert signal for use with an aerosol provision system configured to generate aerosol from an aerosol precursor material, an aerosol provision device for enabling the generation of an aerosol from an aerosol precursor material, and an aerosol provision system which is configured to permit aerosol to be generated from the aerosol precursor material when the alert unit provides an alert to the user.

While the above described embodiments have in some respects focused on some specific example aerosol provision systems, it will be appreciated the same principles can be applied for aerosol provision systems using other technologies. That is to say, the specific manner in which various aspects of the aerosol provision system function are not directly relevant to the principles underlying the examples described herein.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention (s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

The invention claimed is:

1. An aerosol provision system for generating aerosol from a liquid aerosol precursor material and tobacco pod, the system comprising:

a consumable part for generating aerosol that is to be provided to a user of the aerosol provision system, wherein the consumable part includes an identification element;

a reusable part configured to enable generation of aerosol from the liquid aerosol precursor and tobacco pod, wherein the reusable part comprises two electrical contacts coupled to the consumable part, and the reusable part is configured to monitor the resistance between the electrical contacts;

control circuitry configured to monitor usage of the aerosol provision system including a usage parameter; and an alert unit configured to output an alert signal;

wherein the control circuitry is configured to (i) read the identification element to provide a unique identifier for the consumable part, and (ii) store the unique identifier in association with a cumulative usage parameter for the consumable part, wherein the control circuitry is configured to determine when a predetermined usage condition for the consumable part has been met, and in response to determining that the predetermined usage condition has been met, to cause the alert unit to output an alert signal, wherein the system is configured to enable generation of the aerosol when the alert unit is outputting the alert, and further wherein the alert unit is configured to cease output of the alert signal in response to a user input, wherein the consumable part is separate to the reusable part and is configured to engage with, either directly or indirectly, the reusable part, wherein the reusable part is configured to continuously detect the presence of the consumable part, and wherein the user input includes a relative decoupling of the consumable part and the reusable part.

2. The aerosol provision system of claim 1, wherein the alert unit is configured to continuously output an alert signal in response to the control circuitry determining that the predetermined usage condition has been met, and is configured to cease output of the continuous alert signal only in response to the user input.

3. The aerosol provision system of claim 1, wherein the predetermined usage condition of the tobacco pod corresponds to a threshold time.

4. The aerosol provision system of claim 1, wherein the reusable part comprises a user input mechanism configured to receive a user input, the user input causing the alert unit to cease output of the alert signal.

5. The aerosol provision system of claim 1, wherein in response to the user input being received, the control circuitry is configured to reset the monitored usage of the aerosol provision system.

6. The aerosol provision system of claim 1, wherein the alert signal is selected from the group consisting of: an optical signal, an acoustic signal, and a haptic signal.

7. The aerosol provision system of claim 1, wherein the consumable part comprises an aerosol modifying material configured to modify an aerosol generated from the aerosol precursor material to provide the aerosol that is to be delivered to the user of the aerosol provision system.

8. The aerosol provision system of claim 7, wherein the predetermined usage condition is a first predetermined usage condition corresponding to use of the tobacco material in the tobacco pod.

9. The aerosol provision system of claim 8, wherein the consumable part is configured such that the tobacco pod is able to be replaced independently of the aerosol precursor material.

10. The aerosol provision system of claim 1, wherein the liquid aerosol precursor and the tobacco pod being separate elements that are configured to be couplable to one another and/or the reusable part.

11. The aerosol provision system of claim 9, wherein the control circuitry is configured to determine when a second predetermined usage condition in relation to the usage of the liquid aerosol precursor material has been met, and in response to determining that the second predetermined usage condition has been met, to cause the alert unit to output a second alert signal for signifying that the liquid aerosol precursor material requires replacement.

12. The aerosol provision system of claim 3, wherein the threshold time for determining whether the predetermined usage condition for the tobacco pod has been met is set to between 170 to 300 seconds, or between 180 and 290 seconds.

13. The aerosol provision system of claim 1, wherein the control circuitry, in response to receiving the user input, is configured to monitor the usage of the aerosol provision system to generate aerosol from an initial condition.

14. A method of generating an alert signal in an aerosol provision system configured to generate aerosol from a liquid aerosol precursor material and a tobacco pod, the aerosol provision system comprising a reusable part including control circuitry and a consumable part including an identification element, wherein the consumable part is separate to the reusable part and is configured to engage with, either directly or indirectly, the reusable part, wherein the method comprises:

monitoring the usage of the system for generating aerosol including a usage parameter;

determining when a predetermined usage condition for the tobacco pod has been met based on the monitored usage of the system;

continuously detecting the presence of the consumable part; and outputting an alert signal in response to determining that the predetermined usage condition has been met, until detection of a user input, wherein the system is configured to enable generation of the aerosol when the alert unit is outputting the alert, wherein control circuitry is configured to (i) read the identification element to provide a unique identifier for the consumable part, and (ii) store the unique identifier in association with a cumulative usage parameter for the consumable part, wherein the user input includes a relative decoupling of the consumable part and the reusable part.

15. An aerosol provision device for enabling the generation of an aerosol from a liquid aerosol precursor material and tobacco pod, wherein the device is configured to be couplable to a consumable part for generating aerosol that is to be provided to a user of the aerosol provision device, wherein the consumable part is separate to the device and is configured to engage with, either directly or indirectly, the device, wherein the consumable part is provided with an identification element and/or a wirelessly-readable element, wherein the device is configured to continuously detect the presence of the consumable part, the device comprising:

a usage monitoring mechanism including control circuitry configured for monitoring usage of the aerosol provision device including a usage parameter, wherein the control circuitry is configured to (i) read the identification element to provide a unique identifier for the consumable part, and (ii) store the unique identifier in association with a cumulative usage parameter for the consumable part; and an alert unit configured to output an alert signal;

wherein the system is configured to enable generation of the aerosol when the alert unit is outputting the alert, wherein, when it is determined that a predetermined usage condition for the tobacco pod has been met on the basis of the output from the usage monitoring mechanism, the alert unit is configured to output an alert signal, and further wherein the alert unit is configured to cease generation of the alert signal in response to a user input, wherein the user input includes a relative decoupling of the consumable part and the device.

16. The aerosol provision system of claim 1, wherein the consumable part comprises a cartridge containing the aerosol precursor material and the tobacco pod, wherein the tobacco pod is releasably coupled to the cartridge.

17. The aerosol provision system of claim 1, wherein the control circuitry is configured to store a plurality of unique identifiers associated with a corresponding plurality of individual consumable parts, and associate each of the plurality of unique identifiers with corresponding cumulative usage parameters for the respective consumable parts.

18. The aerosol provision system of claim 11, wherein, when the first predetermined usage condition has been met, the system is configured to permit generation of aerosol while the alert signal signifying that the tobacco pod requires replacement is being output, and wherein, when the second predetermined usage condition in relation to the usage of the liquid aerosol precursor material has been met, the control circuitry is configured to prevent power being supplied to a heater for generating aerosol from the liquid aerosol precursor material.

* * * * *